US007540677B2

(12) United States Patent
Allwright

(10) Patent No.: US 7,540,677 B2
(45) Date of Patent: Jun. 2, 2009

(54) MEDIA TRAY, PRINTING SYSTEM AND METHOD

(75) Inventor: Julia A. Allwright, London (GB)

(73) Assignee: Xerox Corporation, Norfolk, CT (US)

( * ) Notice: Subject to any disclaimer, the term of this patent is extended or adjusted under 35 U.S.C. 154(b) by 602 days.

(21) Appl. No.: 11/443,753

(22) Filed: May 31, 2006

(65) Prior Publication Data

US 2007/0280768 A1 Dec. 6, 2007

(51) Int. Cl.
*B41J 13/10* (2006.01)
*B65H 1/04* (2006.01)

(52) U.S. Cl. ..... 400/624; 271/162

(58) Field of Classification Search ..... None
See application file for complete search history.

(56) References Cited

U.S. PATENT DOCUMENTS 4,786,042 A 11/1988 Stemmle
5,333,852 A 8/1994 Milillo et al.
5,596,399 A 1/1997 Dempsey et al.
6,116,590 A 9/2000 Yokoyama et al.
6,170,701 B1 1/2001 Youn
6,471,206 B1 10/2002 Spina et al.
6,985,265 B2 1/2006 Ito
7,284,754 B2 * 10/2007 Takahashi et al. ..... 271/171
2005/0133983 A1 * 6/2005 Jacobs et al. ..... 271/145
2006/0222434 A1 * 10/2006 Kitamura et al. ..... 400/624

* cited by examiner

*Primary Examiner*—Daniel J Colilla
*Assistant Examiner*—Allister Primo
(74) *Attorney, Agent, or Firm*—Fay Sharpe LLP

(57) ABSTRACT

A media tray includes a tray body having a first wall. A first media guide is moveably supported along the tray body. A second media guide is moveably supported along the tray body and disposed approximately transverse to the first media guide. First and second brackets are supported along the first wall. The first bracket is operatively connected to said first media guide and the second bracket is operatively connected to the second media guide. A printing system includes a plurality of size-indicating devices, and a media tray is in operative association with the size-indicating devices. A method of operating a printing system includes moving the first or second media guides to reposition the first or second brackets.

20 Claims, 13 Drawing Sheets

| | | | 01100 | 11010 | 11001 | 00011 | 00101 | 00110 | 00010 | 10100 | 00000 | |
|---|---|---|---|---|---|---|---|---|---|---|---|---|
| G | WIDTH SIZES | 297 | A4 LEF<br>01111 | LTR LEF<br>11011 | LTR LEF<br>11011 | CUSTOM<br>00011 | CUSTOM<br>00111 | CUSTOM<br>00111 | CUSTOM<br>00011 | A3 SEF<br>10111 | CUSTOM<br>00011 | 00011 |
| F | | 279.4 | CUSTOM<br>01101 | LTR LEF<br>11011 | EXEC SEF<br>11001 | CUSTOM<br>00011 | CUSTOM<br>00101 | CUSTOM<br>00111 | CUSTOM<br>00011 | A4 SEF<br>10101 | TAB SEF<br>00001 | 00001 |
| E | | 215.9 | CUSTOM<br>11100 | CUSTOM<br>11010 | EXEC SEF<br>11001 | LTR SEF<br>10011 | A4 SEF<br>10101 | FOLIO SEF<br>10110 | LEGAL SEF<br>10010 | CUSTOM<br>10100 | CUSTOM<br>10000 | 10000 |
| D | | 210 | CUSTOM<br>11100 | CUSTOM<br>11010 | EXEC SEF<br>11001 | LTR SEF<br>10011 | A4 SEF<br>10101 | FOLIO SEF<br>10110 | LEGAL SEF<br>10100 | CUSTOM<br>10000 | CUSTOM<br>10000 | 10000 |
| C | | 184.2 | A5 SEF<br>01100 | CUSTOM<br>11010 | EXEC SEF<br>11001 | CUSTOM<br>01011 | CUSTOM<br>01101 | CUSTOM<br>01110 | CUSTOM<br>01010 | CUSTOM<br>11100 | CUSTOM<br>01000 | 01000 |
| B | | 148.5 | A5 SEF<br>01100 | STMT SEF<br>11110 | CUSTOM<br>11101 | CUSTOM<br>00111 | CUSTOM<br>00101 | CUSTOM<br>00110 | CUSTOM<br>00110 | CUSTOM<br>10100 | CUSTOM<br>00100 | 00100 |
| A | | 139.7 | A5 SEF<br>01100 | STMT SEF<br>11110 | CUSTOM<br>11101 | CUSTOM<br>00111 | CUSTOM<br>00101 | CUSTOM<br>00110 | CUSTOM<br>00110 | CUSTOM<br>10100 | CUSTOM<br>00100 | 00100 |
| | | | 210 | 215.9 | 266.7 | 279.4 | 297 | 330.2 | 355.6 | 420 | 431.8 | |
| | | | LENGTH SIZES | | | | | | | | | |
| | | | 1 | 2 | 3 | 4 | 5 | 6 | 7 | 8 | 9 | |

FIG. 12

| | | | 0111 | 1011 | 1001 | 1110 | 0101 | 1000 | 0011 | 0010 | 1100 | |
|---|---|---|---|---|---|---|---|---|---|---|---|---|
| G | WIDTH SIZES | 297 | A4 LEF<br>10111 | LTR LEF<br>11011 | CUSTOM<br>11001 | LTR SEF<br>11110 | A4 SEF<br>10101 | FOLIO SEF<br>11000 | LEGAL SEF<br>10011 | A3 SEF<br>10010 | TAB SEF<br>11100 | 1 |
| F | | 279.4 | A4 LEF<br>10111 | LTR LEF<br>11011 | CUSTOM<br>11001 | LTR SEF<br>11110 | A4 SEF<br>10101 | FOLIO SEF<br>11000 | LEGAL SEF<br>10011 | A3 SEF<br>10010 | TAB SEF<br>11100 | 1 |
| E | | 215.9 | A4 LEF<br>10111 | LTR LEF<br>11011 | CUSTOM<br>11001 | LTR SEF<br>11110 | A4 SEF<br>10101 | FOLIO SEF<br>11000 | LEGAL SEF<br>10011 | A3 SEF<br>10010 | TAB SEF<br>11100 | 1 |
| D | | 210 | A4 LEF<br>10111 | LTR LEF<br>11011 | CUSTOM<br>11001 | LTR SEF<br>11110 | A4 SEF<br>10101 | FOLIO SEF<br>11000 | LEGAL SEF<br>10011 | A3 SEF<br>10010 | TAB SEF<br>11100 | 1 |
| C | | 184.2 | A5 SEF<br>00111 | STMT SEF<br>01011 | EXEC SEF<br>01001 | CUSTOM<br>01110 | CUSTOM<br>00101 | CUSTOM<br>01000 | CUSTOM<br>00011 | CUSTOM<br>00010 | CUSTOM<br>01100 | 0 |
| B | | 148.5 | A5 SEF<br>00111 | STMT SEF<br>01011 | EXEC SEF<br>01001 | CUSTOM<br>01110 | CUSTOM<br>00101 | CUSTOM<br>01000 | CUSTOM<br>00011 | CUSTOM<br>00010 | CUSTOM<br>01100 | 0 |
| A | | 139.7 | A5 SEF<br>00111 | STMT SEF<br>01011 | EXEC SEF<br>01001 | CUSTOM<br>01110 | CUSTOM<br>00101 | CUSTOM<br>01000 | CUSTOM<br>00011 | CUSTOM<br>00010 | CUSTOM<br>01100 | 0 |
| | | | 210 | 215.9 | 266.7 | 279.4 | 297 | 330.2 | 355.6 | 420 | 431.8 | |
| | | | LENGTH SIZES | | | | | | | | | |
| | | | 1 | 2 | 3 | 4 | 5 | 6 | 7 | 8 | 9 | |

FIG. 13
PRIOR ART

MEDIA TRAY, PRINTING SYSTEM AND METHOD

BACKGROUND

The present disclosure broadly relates to printing systems and, more particularly, to a media tray, printing system and method of operation for improved media size and/or orientation detection.

Known printing systems are generally capable of marking sheets of media of a variety of types (e.g., plain paper, bond paper, recycled paper, card stock, transparencies), sizes (e.g., letter, legal, A3, A4) and/or in different orientations (e.g., long-edge feed, short-edge feed). Typically, a known printing system will include at least one media tray capable of receiving a bulk quantity (e.g., stack, package, ream) of sheets of media and introducing the bulk quantity to a suitable sheet feeding system or mechanism to advance individual sheets in an known manner. Often, known printing systems will include numerous media trays with each tray receiving a different type, size and/or orientation of sheet media.

Many known printing systems are capable of determining which particular one of a number of pre-defined sizes and/or orientations of sheet media have been loaded into the storage tray. Unfortunately, these and other known printing systems and media tray arrangements suffer from problems and disadvantages that can, in certain applications, limit the use and/or effectiveness of the same.

One such problem is that known systems are typically only capable of detecting a minimal number of sizes and/or orientations of sheets of media. This can be due to the operational strategy that is used and/or the components or arrangement thereof that is used by the sensing system.

Known operational strategies that are commonly used for size and/or orientation detection include sensing only one direction (e.g., width dimension only, length dimension only) and sensing in two directions (e.g., both length and width dimensions). Clear disadvantages exist with strategies that detect only one dimension, as sheet media with identical edge dimensions cannot be differentiated. For example, a printing system that only receives a sensor signal indicating that the loaded sheet media has an 11 inch dimension would not, without more information, be able to distinguish between 8-½ inch×11 inch media oriented long-edge first and 11 inch×17 inch media oriented short-edge first.

Due to the substantial disadvantages single direction sensing systems, many known printing systems detect two dimensions of loaded sheets (e.g., media length and media width). One example of such a known printing system is disclosed in U.S. Pat. No. 5,333,852 to Millilo et al. (hereinafter Millilo), which utilizes five different switches to detect the size and/or orientation of the loaded sheet media. One switch (S1 in FIG. 7 of Millilo) is dedicated to sensing the presence or absence of the sheet media tray within the printing system. Such switches are commonly referred to "tray home" switches, which generate a signal indicating that the associated media tray is received within the printing system in a "home" position. Another switch (S5 in FIG. 7 of Millilo) senses the "width" dimension of the loaded media, and its switch state depends upon the position of the "width" guide within the media tray. The remaining three switches (S2-S4 in FIG. 7 of Millilo) detect the "length" dimension of the loaded media. An actuator arm includes several actuators or projections that selectively engage switches S2-S4 depending upon the position of the actuator arm, which is connected to the "length" guide within the tray. The arrangement in Millilo, as well as other known arrangements, permits the printing system to automatically detect the size of the loaded media based upon the combined condition or operational state (e.g., open or closed) of the switches.

One disadvantage of known arrangements, such as that disclosed in Millilo, for example, is that selectively actuating the given number of switches in such a manner permits only limited number of switch combinations. Therefore, only a limited number of media sizes and/or orientations can be detected. For example, Millilo discloses the detection of about 7 different media sizes and/or orientations using the arrangement disclosed therein. However, as printing systems become increasingly sophisticated, it is commonly desirable for printing systems to recognize a greater variety of media sizes and/or orientations. It will be recognized that a greater number of media sizes and/or orientations could be detected by the arrangement in Millilo if a greater number of switches were to be used. However, the use of a greater number of switches would be likely to undesirably increase production costs. Additionally, such a modification would also be likely to generate design and/or assembly issues due to the increased usage of space within the printing system.

Other known arrangements utilize sensing systems similar to that disclosed in Millilo. However, such other known systems avoid the use of a dedicated switch for determining the presence or absence of the media tray (i.e., a "tray home" switch), and instead utilize that switch as a fourth "length" switch. This permits an increased number of media sizes and/or orientations to be detected. For example, FIG. 13 illustrates a media size and orientation matrix having columns 1 through 9 extending along the bottom of the chart representing known length dimensions and rows A through G extending along the left side representing known width dimensions. A row extends across the top of the chart and includes a representative condition or state of the four length switches (e.g., 0111, 1011, 1001, 1110, 0101, 1000, 0011, 0010 and 1100), with a "0" representing an open switch and a "1" representing a closed switch. A column extends along the right side of the chart and includes representative conditions of the single width switch (e.g., 0 or 1). Generally, then, a size and/or orientation of a sheet of media can be determined based upon the combined conditions or states of the length and width switches using the arrangement $W_1L_1L_2L_3L_4$ in which the "W" represents the width switch state and each "L" represents a length switch state.

As an example, a media length of 210 mm is represented in column 1 by the length switch state 0111. A media width of 148.5 mm is represented in row B by the width switch state 0. A sheet of media having a width of 148.5 mm and a length of 210 mm is more commonly referred to A5 sized media, which would be oriented to feed short-edge first (SEF), and would be addressed in the chart by combined switch state 00111. As another example, a media length of 355.6 mm is represented in column 7 by length switch state 0011, and a media width of 215.9 mm is represented in row E by switch state 1. A sheet of media having such length and width dimensions would more commonly be referred to as Legal sized media, which would be oriented to feed short-edge first (SEF), and would be addressed in the chart by combined switch state 10011.

Using a sensing arrangement and strategy such as that shown in FIG. 13, known printing systems can identify an increased number of pre-defined sheet media sizes and orientations over earlier systems, such as that in Millilo, for example, due to the additional length switch that is available. As an example, FIG. 13 identifies 11 different sizes and/or orientations of sheet media in bold characters. However, these systems and arrangements also include problems and disadvantages that can limit the application and/or use thereof.

One example of such an issue will be recognized from FIG. 13, in which rows A-C of each column are represented by the same combined switch state. Similarly, rows D-G of each column are also represented by the same combined switch state. As an example, sheet media referred to as Executive sized media oriented to feed short-edge first is shown in box 3C as being addressed by combined switch state 01001. As such, a printing system receiving an electrical or other signal representing this combined switch state would identify the media within the tray as being Executive sized media oriented to feed short-edge first within the tray. However, sheet media having a length of 266.7 mm (column 3) and a width of 139.7 mm (row A) or 148.5 mm (row B), would also return a combined switch state of 01001. As a result, such sheet media would be misidentified by the printing system as being Executive sized media, even though it would be of a substantially different width than Executive sized media. In FIG. 13, there are 16 occurrences of a smaller sheet of media being identified as a larger sheet of media. These occurrences are indicated by a heavy or bold lined border, and include boxes 1A, 1D-F, 2D-E, 3A-B, 4D, 6D, 7D, 8D-F, and 9D-E. Additionally, there are 14 occurrences of a larger sheet of media being identified as a smaller sheet of media. These occurrences are indicated in FIG. 13 by a double lined border, and include boxes 1C, 2B-C, 2G, 4F-G, 5E-G, 6F-G, 7F-G and 9G.

While it is desirable to minimize both types of occurrences of misidentification, the misidentification of a smaller sheet of media as being a larger sheet of media may be more problematic in some applications than in others. One example of an application in which is desirable to maximize the number of recognized media sizes and/or orientations and minimize detections of smaller sheet of media as larger sheets involves printing systems, such as those that utilize ink or toner as a marking substance, for example. Typically, such printing systems apply the ink or toner to a rotating drum before the marking substance is transferred onto a passing sheet of media. It will be recognized, however, that ink and toner cannot readily be removed from the rotating drum other than by applying the ink to a passing sheet of media. As such, it is beneficial to avoid the application of a marking substance along the rotating drum outside the extents of the sheet of media, as the ink or toner that is not transferred to the passing sheet of media will remain on the drum. Repeated occurrences of such an event could have undesirable effects on output quality and/or the components themselves.

BRIEF DESCRIPTION

A media tray for an associated printing system is provided that includes a tray body including a first wall, a first media guide moveably supported along the tray body, and a second media guide moveably supported along the tray body and disposed approximately transverse to the first media guide. A first bracket is supported along the first wall and includes a first bracket wall with a plurality of engagement portions and a first plurality of non-engagement portions disposed along the first bracket wall. The first bracket being operatively connected to the first media guide such that moving the first media guide relative to the tray body causes a related translation of the first bracket along the first wall. A second bracket is supported along the first wall and includes a second bracket wall with a second plurality of engagement portions and a second plurality of non-engagement portions disposed along the second bracket wall. The second bracket being operatively connected to the second media guide such that moving the second media guide relative to the tray body causes a related translation of the second bracket along the first wall.

A printing system is provided that includes a sheet media source including a sheet media tray for supporting a quantity of associated sheets of media having first and second dimensions. A marking unit is in operative communication with the sheet media source and is adapted to receive sheets of media therefrom. A sheet media output is in operative communication with the marking unit. A control system is in communication with at least the marking unit and includes a plurality of size-indicating devices disposed along the sheet media source in operative association with the sheet media tray. The size-indicating devices are adapted to generate an output signal indicative of a state thereof. The sheet media tray includes a tray body for receiving the quantity of associated sheets of media. The tray body includes a bottom wall and a rear wall extending from the bottom wall. First and second media guides are supported along the tray body and are moveable relative to the bottom wall. First and second brackets are moveably supported along the rear wall and at least partially overlap one another. The first bracket includes a first plurality of apertures and the second bracket includes a second plurality of apertures. The first bracket is operatively connected to the first media guide such that a movement of the first media guide generates a corresponding translation of the first bracket relative to the rear wall. The second bracket is operatively connected to the second media guide such that a movement of the second media guide generates a corresponding translation of the second bracket relative to the rear wall.

A method of operating a printing system is provided that includes providing a printing system including a sheet media source, a marking unit in operative association with the sheet media source, a sheet media outlet in operative association with the marking unit, and a control system in communication with at least the marking engine and including a plurality of size-indicating devices disposed along the sheet media source. Each of the plurality of size-indicating devices having an operative state. The method also includes providing a sheet media tray for receiving a quantity of sheets of media having first and second dimensions. The sheet media tray includes a tray body supporting the quantity of sheets of media and a first wall. A first media guide is moveably supported on the tray body, and a second media guide is moveably supported on the tray body and disposed generally transverse to the first media guide. A first bracket is supported along the first wall and is operatively connected to the first media guide, and a second bracket is supported along the first wall and is operatively connected to the second media guide. The first bracket including a first plurality of engagement portions and a first plurality of non-engagement portions. The second bracket includes a second plurality of engagement portions and a second plurality of non-engagement portions. The method further includes moving the sheet media tray into a first tray position in which the first and second media guides are exposed. The method also includes moving the first media guide into a first guide position which has a relation to the first dimension of the quantity of sheets of media. The movement of the first media guide causing a corresponding movement of the first bracket relative to the first wall. The movement of the first bracket causing one or more of the first plurality of engagement portions and one or more of the first plurality of non-engagement portions to be disposed in approximate alignment with the plurality of size-indicating devices. The method further includes moving the second media guide into a second guide position which has a relation to the second dimension of the quantity of sheets of media. The movement of the second media guide causing a corresponding movement of the second bracket relative to the first wall. The movement of the second bracket causing one or more of the second plurality of engagement portions and one or more of the second plurality of non-engagement portions to be disposed in approximate alignment with the plurality of size-indicating devices. The method also includes moving the sheet media tray into a second tray position in which at least one of the of the first and second brackets is operatively associated with the plurality of size-indicating devices. The method further includes determining a size of the quantity of sheets of media based at least in part upon an operative state of the plurality of size-indicating devices as influenced by at least one of the first and second brackets.

BRIEF DESCRIPTION OF THE DRAWINGS

FIG. 12 is a representation of a media-size and/or orientation identification arrangement according to the present disclosure.

FIG. 13 is representation of a known media-size and/or orientation identification arrangement.

DETAILED DESCRIPTION

The terms "print", "printing" and "marking" as used herein are to be broadly interpreted to encompass any action or process involving the production or output of sheet media having text, images, graphics and/or other indicia formed thereon by any process, such as inkjet or electrophotographic processes, for example. The terms "printer" and "printing system" as used here are to be broadly interpreted to encompass any device, apparatus or system that is capable of performing a "printing" action. Examples of such equipment and/or systems include, without limitation, desktop printers, network printers, stand-alone copiers, multi-function printer/copier/facsimile devices, and highspeed printing/publishing systems. Additionally, such exemplary embodiments of equipment, systems and/or processes can utilize sheet media of any suitable type, kind, material, quality or thickness (e.g., recycled paper, plain paper, bond paper, coated paper, card stock, transparencies and/or other polymeric media), for example. Furthermore, such exemplary equipment, systems and/or processes can output indicia on such sheet media using any printing or marking substance, such as liquid ink, solid ink, toner and/or colorant, for example, in monochrome (e.g., black) or one or more colors, or any combination thereof.

Figure 1:
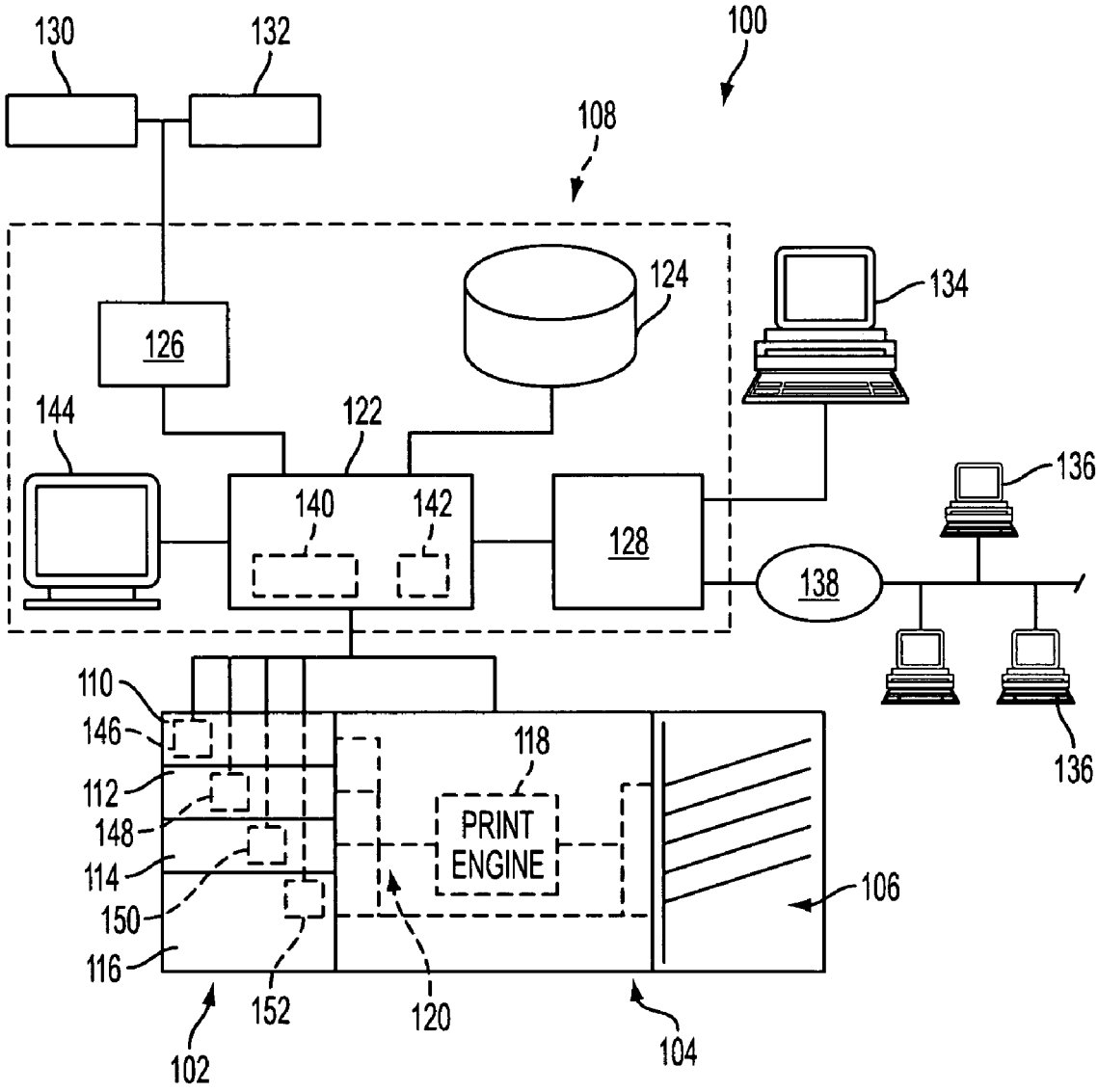
FIG. 1 is a schematic representation of a printing system according to the present disclosure.

Turning now to the drawings wherein the showings are for the purpose of illustrating exemplary embodiments, and not for limiting the same, FIG. 1 schematically illustrates a printing system 100 that includes a sheet media source 102, a printing unit or section 104 in operative communication with the sheet media source, and a sheet media outlet 106 in operative communication with the printing unit. Printing system 100 also includes a control system 108 in communication with one or more of the sheet media source, the printing unit and/or the sheet media outlet for selective operation thereof. In the embodiment shown in FIG. 1, control system 108 is in communication with all of these systems. It is to be distinctly understood, however, that aspects of the present disclosure are applicable to a wide variety of types and kinds of printing systems, and that printing system 100 is merely exemplary of one suitable printing system.

Media source 102 is shown in FIG. 1 as including multiple media supply trays 110, 112, 114 and 116. It will be appreciated that the media supply trays are capable storing and are operative to present individual sheets of media to a suitable sheet feeding system or mechanism for dispensing the individual sheets. Suitable sheet feeding systems and/or mechanisms are well known by those of skill in the art, and can be displaceable to engage a stationary supply of sheet media or can remain stationary with the supply of sheet media being introduced thereto in a suitable manner, such as by using a media elevation plate, for example. Additionally, it will be appreciated that media supply trays 110-116 are capable of receiving and supporting bulk quantities of sheet media of anyone of a variety of different sizes (e.g., letter, legal, A4) and/or orientations (e.g., short-edge feed, long-edge feed).

Printing section 104 includes one or more printing engines 118 in communication with media source 102 through a media transport pathway 120. It will be appreciated that the one or more printing engines can be of any suitable type or kind, and that such one or more printing engines will operate in accordance with known marking principles, such as ink jet marking or electrophotographic marking, for example.

Sheet media outlet 106 is in communication with the one or more printing engines of printing section 104 via media pathway 120. The sheet media outlet can be of any suitable type or kind, and can optionally be capable of performing one or more finishing operations of any type or kind. For example, sheet media outlet 106 could be operative to stack, collate, staple, hole punch, offset, bind, fold, insert separator sheets, and/or any combination of these or any other finishing operations. As will be recognized by one of skill in the art, sheet media is fed from media source 102 to the one or more printing engines 110 along media pathway 120. Once output by the printing engine or engines, the marked sheet media is delivered to the sheet media outlet and can simply be stacked, or one or more optional finishing operations can be performed.

Control system 108 includes a controller 122 that is in communication with media source 102, printing unit 104 and sheet media output 106. Control system 108 also includes a data storage device 124, such as a non-volatile memory or hard drive, for example, suitable for storing print jobs, settings, attributes and any other data and/or information. The data storage device is shown in FIG. 1 as being in communication with controller 122. Additionally, control system 108 can optionally include an input section 126 and/or a communication interface 128, both of which are shown in communication with controller 122. Either or both of input section 126 and communication interface 128 can be used to generate, receive, input or otherwise provide print jobs to the printing system. For example, input section 118 could optionally include a raster output scanning system 130 suitable for scanning paper documents and transmitting rasterized images of the scanned documents to the controller or another system or component. As another example, the input section could include an optional memory card reader 132 adapted to retrieve document files, image files or other data or information from memory cards, and transmit such files, data or information to controller 122 or another system or component. As a further example, a print job could be transferred or otherwise sent to the printing system through communication interface 128 from a standalone computer 134, and/or from a computer workstation or terminal 136 through a suitable computer network 138.

A print job, however transmitted or received, can be directly communicated to controller 122 for processing or the print job can be stored in data storage device 124 until recalled for printing. In the exemplary embodiment shown, control system 108 also includes a processing device 140 of any suitable type or kind, such as a microprocessor, for example, for controlling the operation of printing system 100. Additionally, a memory 142 can be used to store software, parameters and other data and/or information for performance and operation of the printing system. A user interface 144, such as a display, keyboard, pointing device or other input device, is in communication with controller 122. In one preferred embodiment, a display is provided that outputs a graphical programming window to the user for entry of user-inputted data. It will be appreciated, however, that such data can be inputted in any suitable manner as well as from other locations and/or using other devices, such as standalone computer 134 or network workstation 136, for example, and that the graphical programming window could optionally be output on the standalone computer or network workstation to facilitate the entry of such data.

The control system also includes a plurality of size-indicating devices disposed in operative association with the media trays of the sheet media source. In the embodiment shown in FIG. 1, control system 108 includes a first plurality of size-indicating devices 146 disposed along sheet media source 102 in operative association with media tray 110. Similarly, second, third and fourth pluralities of size-indicating devices 148,150 and 152 are disposed along the sheet media source and operatively associated with media trays 112,114 and 116, respectively. Each plurality of size-indicating devices can be in communication with controller 122 or another suitable component or system for communicating signals having a relation to the size and/or orientation of any sheet media stored within the media trays. In one preferred embodiment, each plurality of size-indicating devices will include five contact switches. Alternately, five contact or non-contact sensors could be used. It will be appreciated, however, that any suitable number of size-indicating indicating devices can alternately be used, such as from about 2 to about 10 size-indicating devices, for example.

Figure 2:
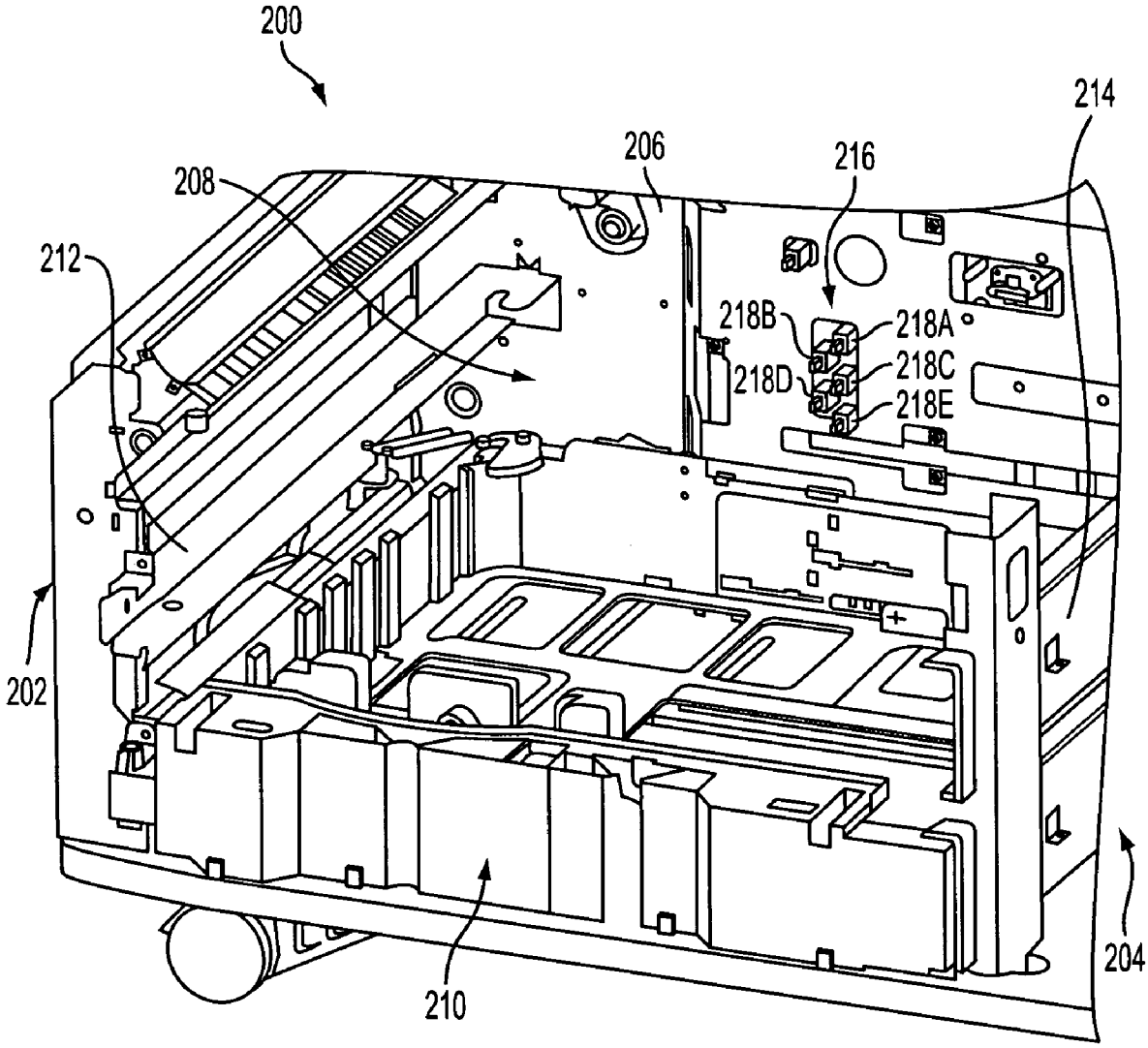
FIG. 2 is a perspective view of a portion of the sheet media source in FIG. 1.

FIG. 2 is perspective view of a partially assembled sheet media source 200, such as sheet media source 102 in FIG. 1, for example. Sheet media source 200 includes opposing sides 202 and 204 and a rear wall 206 extending therebetween. An open front (not numbered) provides access to a chamber 208 within which quantities of sheet media (not shown) can be received, such as within a media tray 210, for example. Sides 202 and 204 respectively include first and second frame walls 212 and 214 suitable for supporting opposing sides of a media tray, such as media tray 210, for example. A plurality of size-indicating devices 216 can be supported along rear wall 206 for each media tray that is to be received into chamber 208. It will be appreciated, however, that size-indicating devices can alternately be supported on or along any other wall or feature in any suitable manner.

In FIG. 2, media tray 210 is supported within chamber 208, so only one plurality of size-indicating devices can be seen. Additionally, plurality 216 is shown in FIG. 2 as including five size-indicating devices 218A-E, such as suitable switches or sensors, for example, that are arranged in two columns in a staggered manner. The physical arrangement of devices 218A-E is well suited and preferred for minimizing space usage. However, it is to be distinctly understood that any other suitable arrangement, configuration and/or construction could alternately be used. Other known components that are typically used, such as a sheet feeding mechanism, for example, have been omitted for purposes of clarity.

Figure 3:
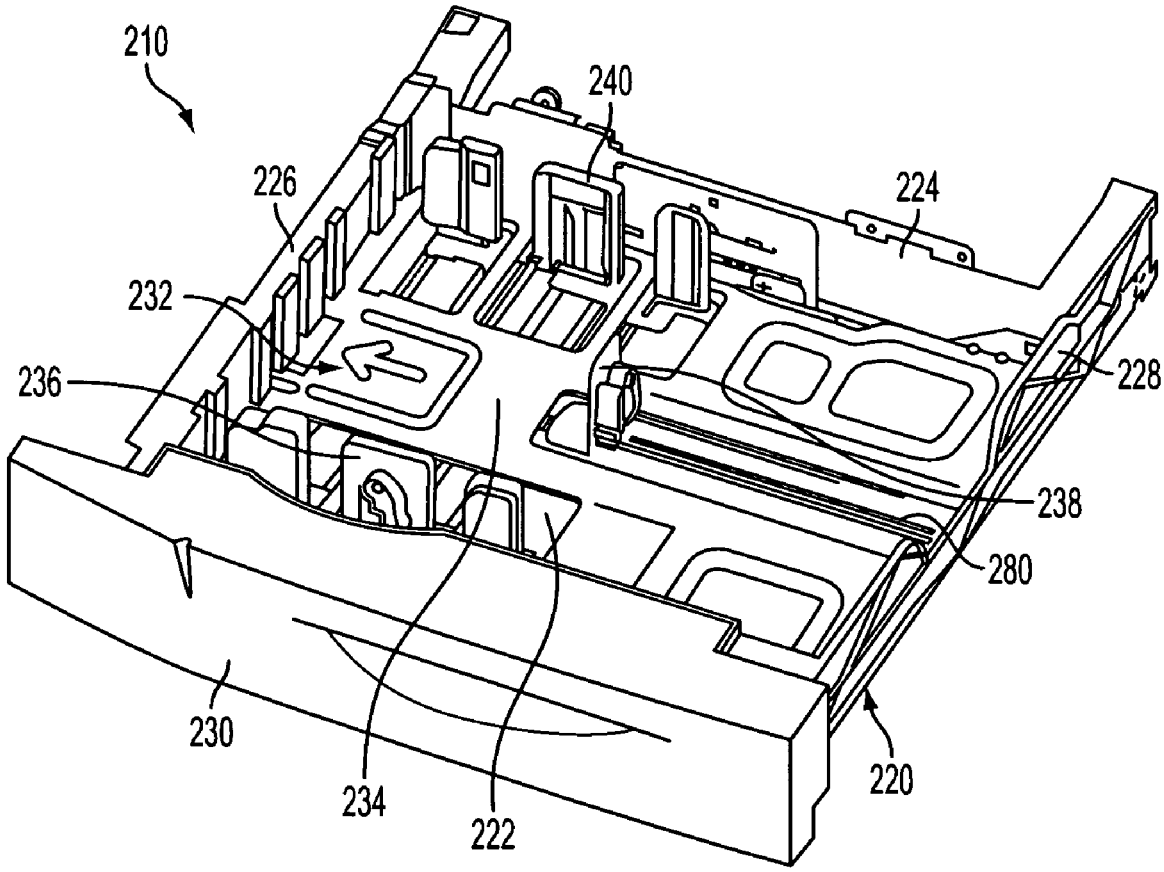
FIG. 3 is a front perspective view of a media tray shown removed from the sheet media source in FIG. 2.
Figure 4:
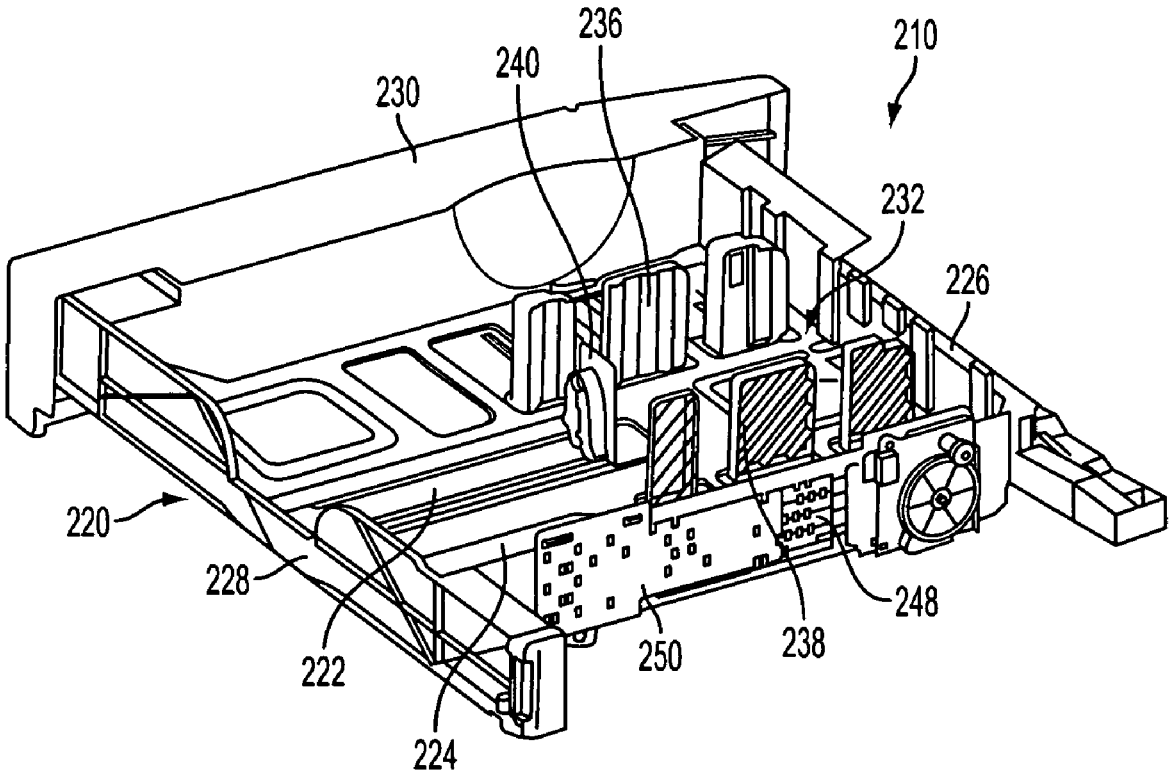
FIG. 4 is a rear perspective view of the media tray in FIG. 3.
Figure 5:
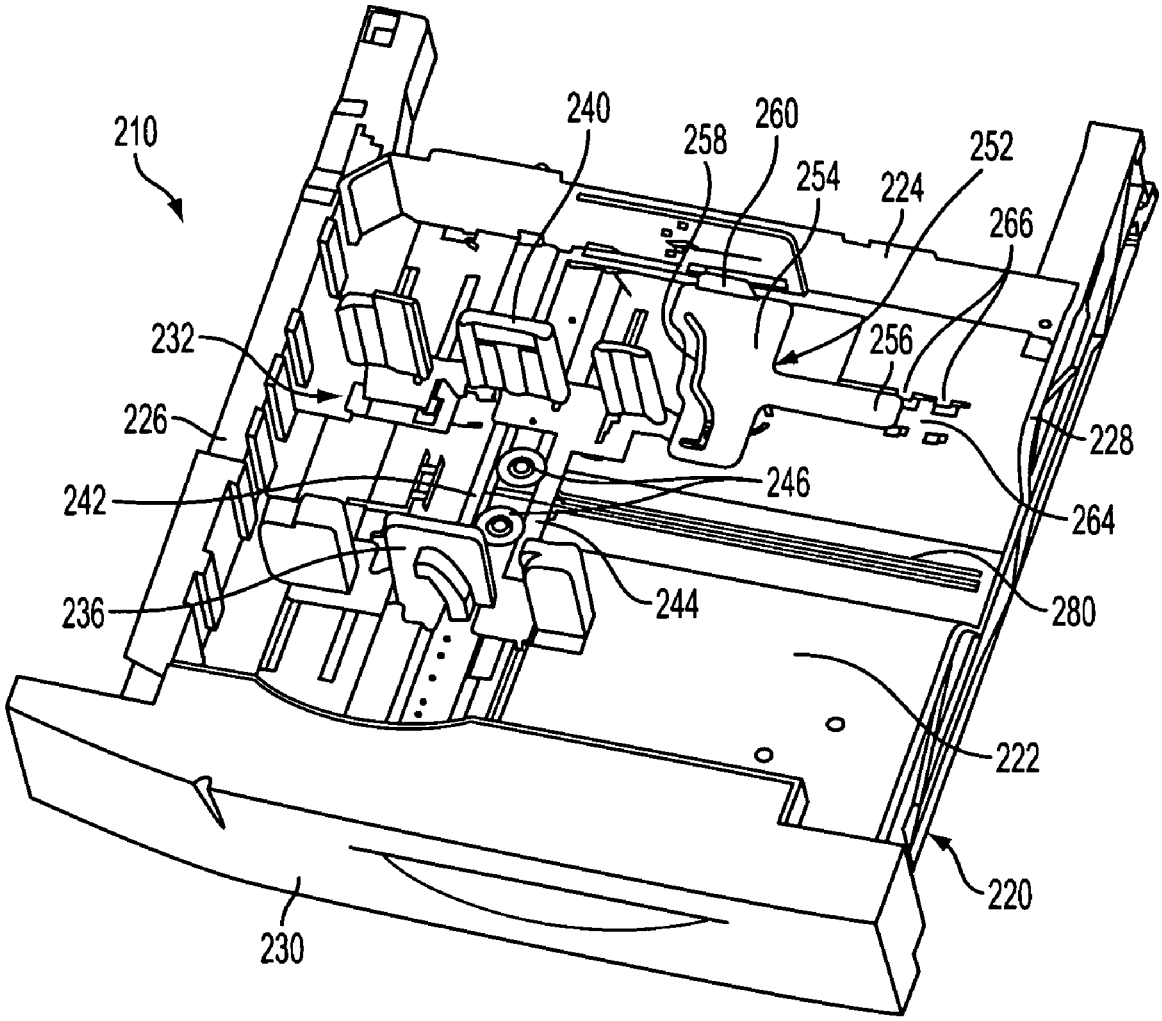
FIG. 5 is another front perspective view of the media tray in FIG. 3 shown with a media elevation plate removed.

FIGS. 3-5 illustrate one embodiment of media tray 210, which includes a tray body 220 having a bottom wall 222 and a rear wall 224 extending from the bottom wall. Opposing side walls 226 and 228 extend from bottom wall 222 generally transverse to rear wall 224. A front wall 230 extends along bottom wall 222 in spaced relation to rear wall 224 but in approximate alignment therewith. Walls 222-230 generally form a cavity 232 within tray body 220 that is suitable for receiving a bulk quantity of sheet media. In one embodiment, a media elevation plate 234 is supported along bottom wall 222 and is suitable for supporting at least one sheet of media within cavity 232. As is well known by those of skill in the art, the media elevation plate can be used to introduce one or more sheets of media to a suitable sheet feeding system or device.

Media tray 210 also includes a first media guide 236 moveably supported on tray body 220. A second media guide 238 is moveably supported on tray body 220 in approximately transverse relation to the first media guide. First media guide 236 is shown as being spaced from rear wall 224 but is in at least approximate alignment therewith. As such, the first media guide is associated with a first dimension of any sheets of media supported within the cavity. The dimension could be established by the position of the first media guide relative to a first wall, such as rear wall 224, for example. Thus, by moving the first media guide, the first dimension could be varied or changed. Alternately, a third media guide 240 can optionally be provided in spaced relation to first media guide 236, but in at least approximate alignment therewith. In this way, the third media guide can be used to establish a media dimension in conjunction with the first media guide rather than using a fixed wall, such as the rear wall.

In one embodiment, the first and third media guides can move independently of one another, such as along the bottom wall of the tray body, for example. However, in the embodiment shown in FIGS. 3-5, first and third media guides 236 and 240 are interconnected with one another, such that movement of one media guide generates a corresponding movement of the other media guide. This can be accomplished in any suitable manner. For example, first media guide 236 can include a first extension 242 having an interengaging profile, such as a gear form, for example, provided thereon and suitably supported on the tray body, such as along bottom wall 222, for example. Third media guide 240 can include a second extension 244 having the same interengaging profile provided thereon and suitably supported along the tray body. The first and second extension can then be interconnected by rotational member, such as pinion gears 246, for example, that interengage the extensions of the first and third media guides such that movement of one media guide generates a corresponding movement of the other media guide.

Second media guide 238 could include a fourth media guide spaced therefrom and operable in a suitable manner, such as that described above with regard to media guides 236 and 240, for example. However, in the embodiment shown, second media guide 238 is supported along the bottom wall in spaced relation to side wall 226 and at least partially establishes a dimension of any sheets of media relative thereto. As such, second media guide is supported in at least approximate alignment with side wall 226, and is moveable along the bottom wall relative thereto. Suitable locking or retaining arrangements can be used to maintain the first, second and third media guides in the desired positions and to selectively permit the repositioning thereof, which arrangements are well known by those of skill in the art.

Media tray 210 also includes first and second brackets 248 and 250 (FIG. 4) supported along the tray body, such as along rear wall 224, for example. The first and third media guides are operatively connected to the first bracket and the second media guide is operatively connected to the second bracket, though it will be appreciated that any suitable arrangement can be used. For example, a first connecting member 252 can be provided that interconnects third media guide 240 and the first bracket. As such, first and/or third media guides 236 and/or 240 are operatively connected to first bracket 248.

Figure 6:
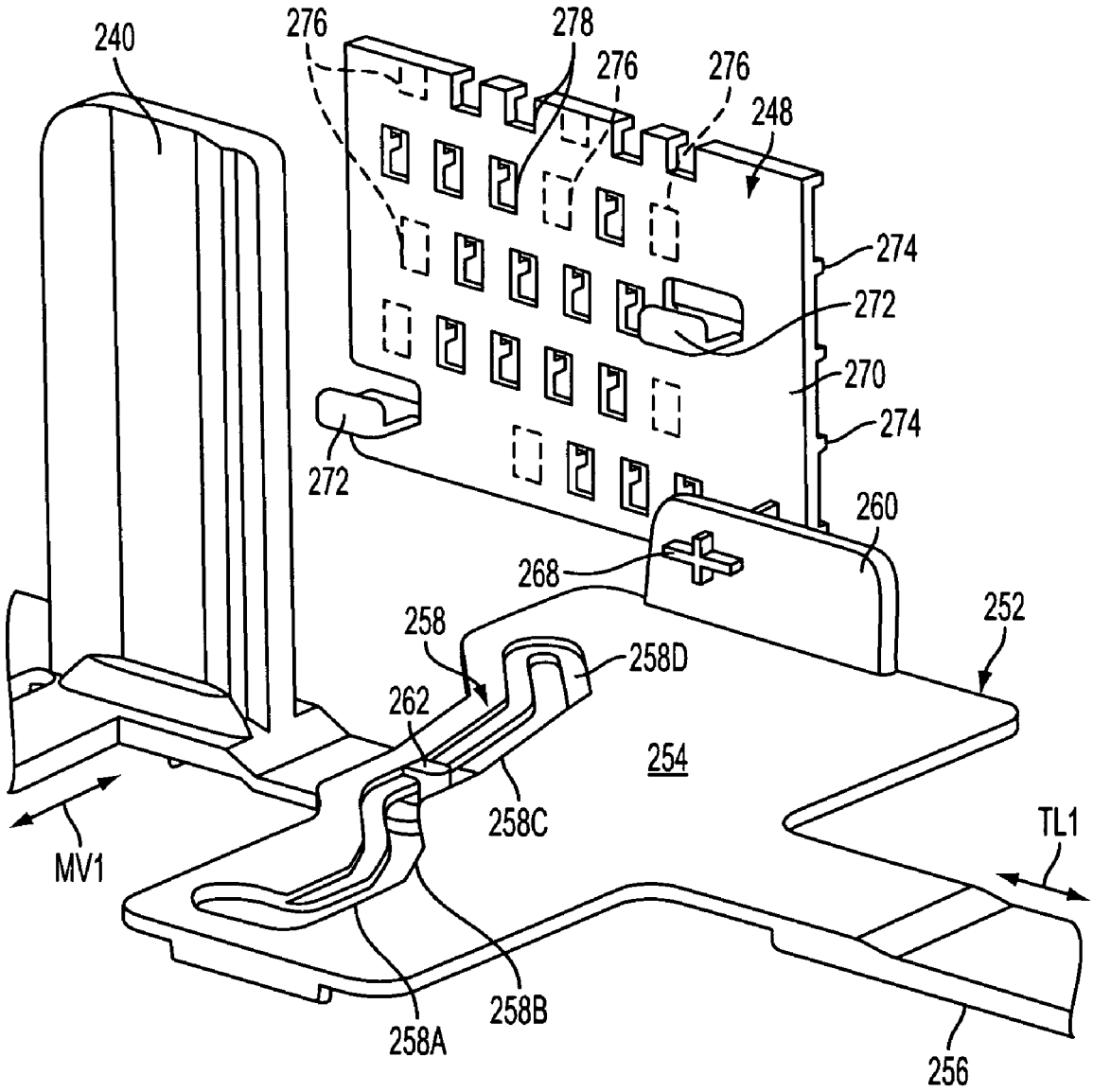
FIG. 6 is a perspective view of one embodiment of a bracket and connecting member in operative association with a sheet media guide.

One embodiment of first connecting member 252 is shown in FIG. 6 as including a central or body portion 254 and an extension 256 projecting therefrom. An elongated slot 258 extends along body portion 254, and a connection portion 260 extends from body portion 254. In the embodiment shown, third media guide 240 includes a projection 262 that engages elongated slot 258. Connecting member 252 is moveably supported along bottom wall 222, and can be guided therealong in any suitable manner. For example, extension 256 can be disposed within a groove 264 formed within bottom wall 222 and can interengage tabs 266 disposed therealong. Thus, a movement of third media guide 240 (and/or a movement of first media guide 236 due to the interengagement therewith), as indicated by arrow MV1, will cause projection 262 move relative to the bottom wall and cause connecting member 252 to translate in an approximately transverse direction, as indicated by arrow TL1, due to the relative motion between projection 262 and elongated slot 258. It will be appreciated that slot 258 can be of any suitable shape, configuration and/or arrangement. For example, the elongated slot could be an approximately linear slot disposed at an angle relative to arrows MV1 and TL1. Alternately, elongated slot 258 can include one or more slot portions, such as one or more linear portions and/or one or more curved portions, for example. In the embodiment shown, elongated slot 258 includes a plurality of linear portions and a plurality of curved portions, as indicated in part by slot portions 258A-D, for example.

First bracket 248 is shown in FIG. 6 as being operatively connected to first connecting member 252. It will be appreciated that the first bracket and the first connecting member can be secured to one another in any suitable manner. For example, first bracket 248 is shown in FIG. 6 as including a projection 268 extending through and engaging connecting portion 260 for transferring movement, such as translational motion in the direction of arrow TL1, for example, to first bracket 248.

In operation, movement of the first and/or third media guide, such as in the direction indicated by arrow MV1, causes a movement of projection 262 along slot 258. The follower-type movement between the projection and the slot generates translational movement of first connecting member 252, such as in the direction indicated by arrow TL1, for example, which is transferred to first bracket 248 through the engagement of connector portion 260 and projection 268. Thus, movement of the first and/or third media guide generates translational movement of first bracket 248 through connecting member 252, though it will be appreciated that any other suitable arrangement of operatively connecting the first media guide and the first bracket can alternately be used.

First bracket 248 includes a bracket wall 270 from which projection 268 extends. As indicated above, first bracket 248 is, in one embodiment, disposed along rear wall 224, though it will be appreciated that any other suitable arrangement could alternately be used. In the exemplary embodiment shown, first bracket 248 includes support portions 272 that extend from bracket wall 270 and are adapted to interengage rear wall 224 in a suitable manner. For example, support portions can slidably engage rear wall 224 for translating movement therealong. Additionally, first bracket 248 can optionally include one or more ribs 274 or other suitable features provided along bracket wall 270.

First bracket 248 also includes a first plurality of engagement portions suitable for engaging a size-indicating device, such as a device of plurality of size-indicating devices 146, 148,150 and/or 152 in FIG. 1, for example. The engagement portions can be of any suitable shape, form or construction, and can be of any suitable number, such as from about 2 to about 250, for example. In the embodiment shown in FIG. 6, the engagement portions are shutoffs or solid wall portions of bracket wall 270, which are indicated by dashed rectangles 276. Additionally, first bracket 248 includes a first plurality of non-engagement portions suitable for being positioned in operative association with a size-indicating device, such as a device of plurality of size-indicating devices 146, for example, but not contacting, actuating or otherwise operatively engaging a size-indicating device. The non-engagement portions can be of any suitable shape, form or construction, and can be of any suitable number, such as from about 2 to about 250, for example. In the embodiment shown in FIG. 6, the non-engagement portions are rectangular apertures or holes 278 formed through bracket wall 270. Furthermore, the engagement portions and non-engagement portions are shown disposed along bracket wall 270 in approximately evenly spaced rows. While it will be appreciated that any suitable spacing, arrangement and/or configuration can be used, in one embodiment at least one row of engagement and/or non-engagement portions is in alignment with at least one of size-indicating device. In one preferred embodiment, the plurality of size-indicating devices, such as devices 146, for example, are evenly spaced in two or more rows and the engagement and/or non-engagement devices are disposed in corresponding and aligned rows.

Figure 7:
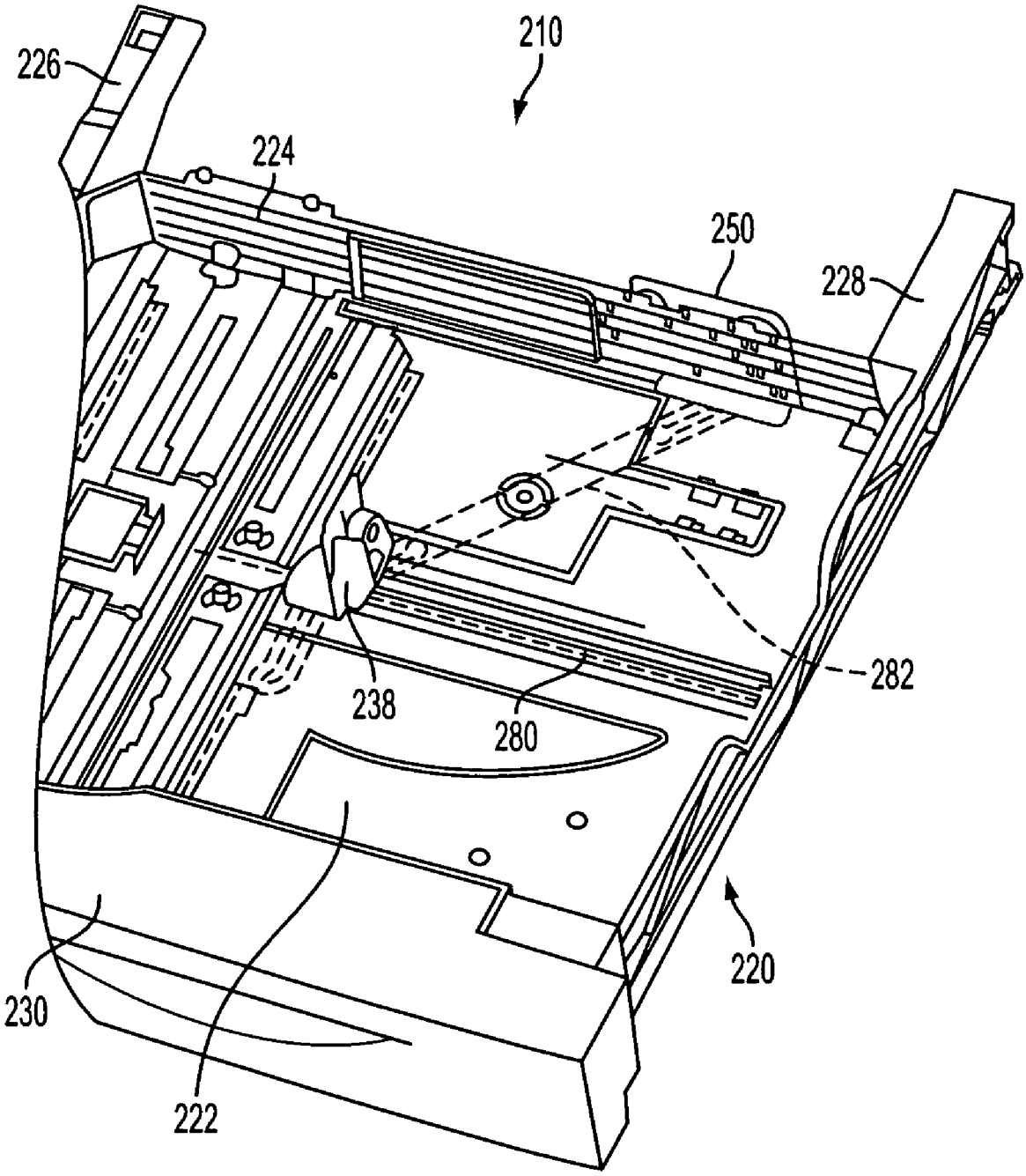
FIG. 7 is a perspective view of another embodiment of a bracket and connecting member in operative association with another sheet media guide disposed along the media tray in FIG. 5.
Figure 8:
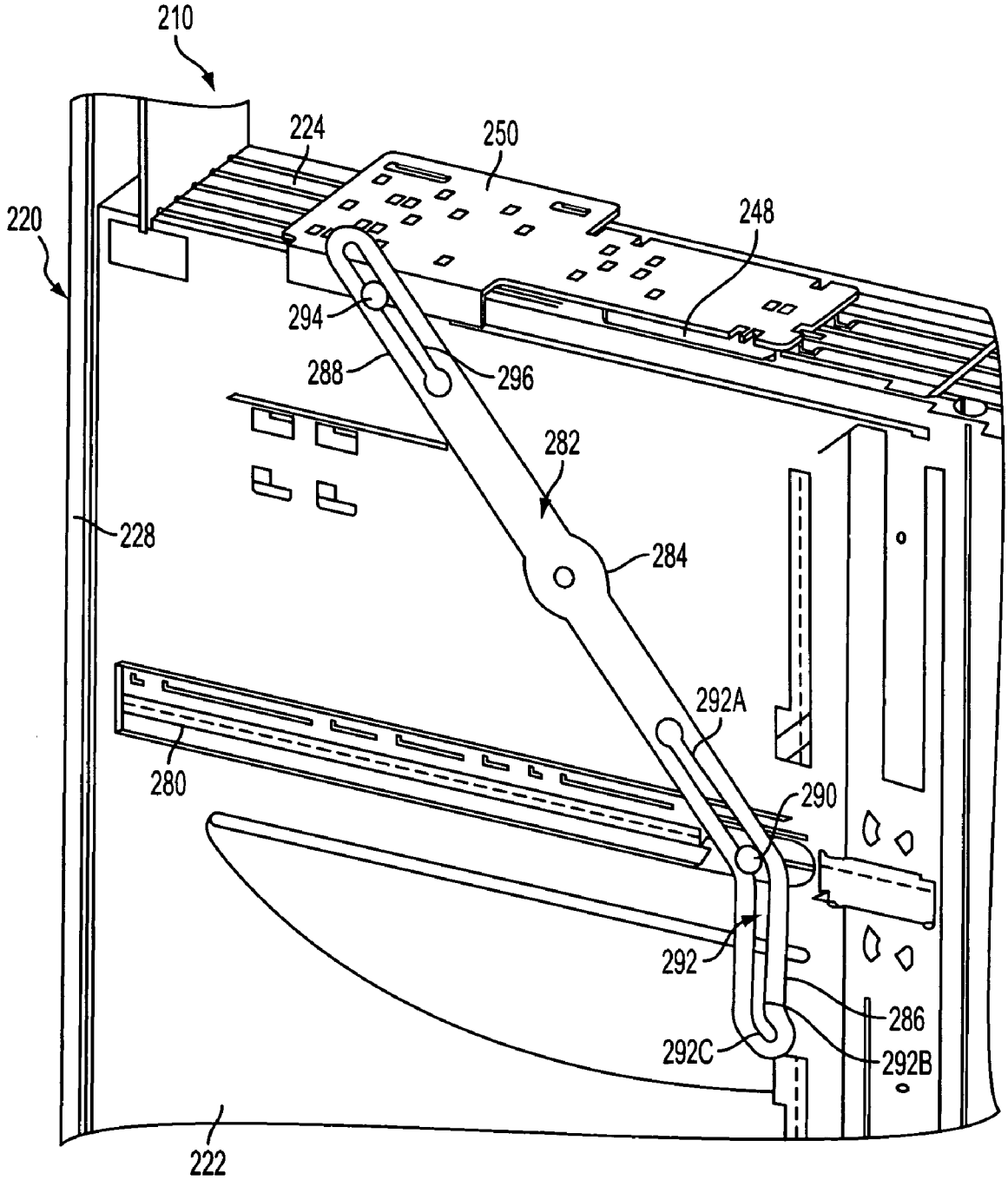
FIG. 8 is a bottom perspective view of the bracket and connecting member in FIG. 7.
Figure 9:
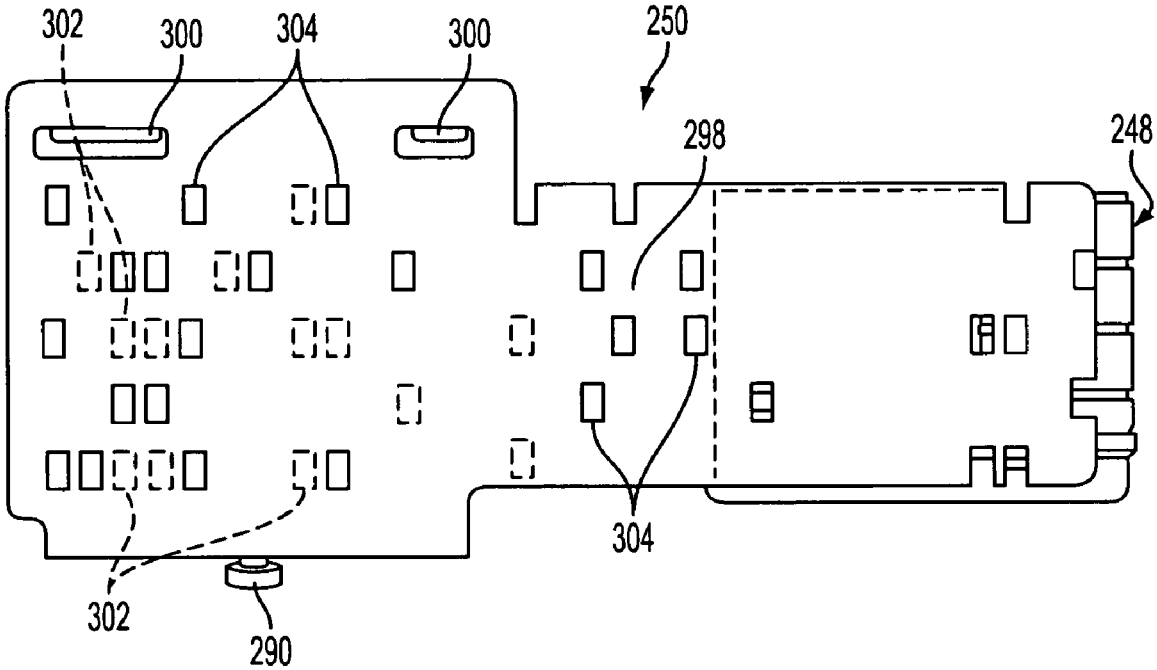
FIG. 9 is a rear view of first and second brackets in a first relative position.
Figure 10:
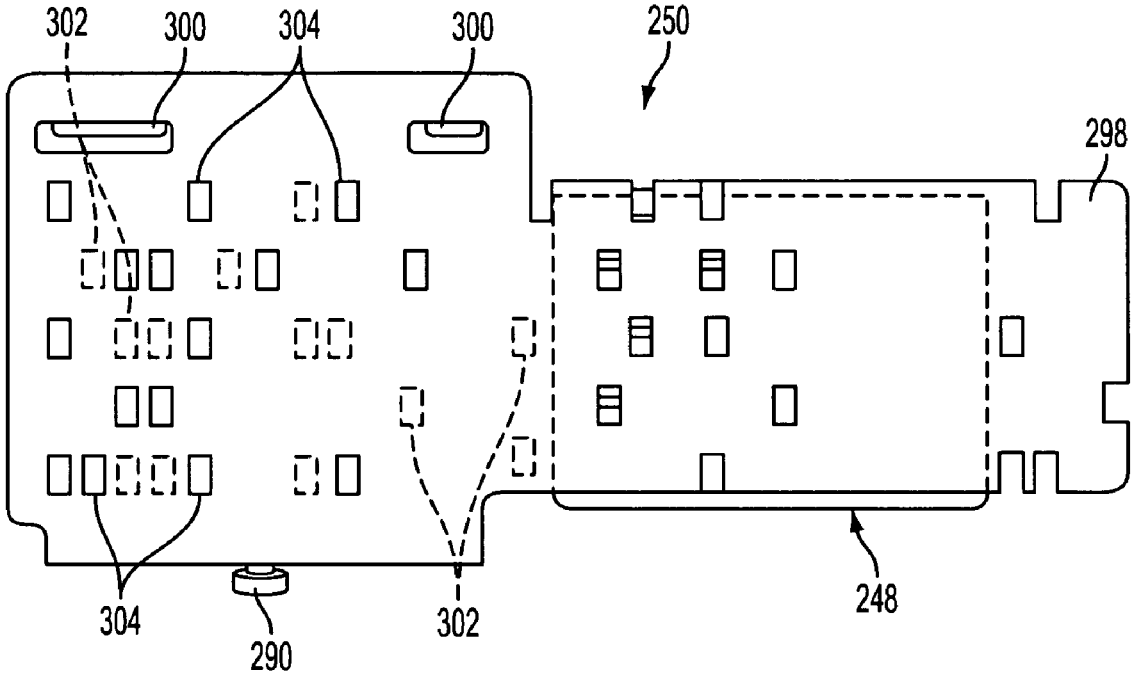
FIG. 10 is a rear view of the brackets in FIG. 9 shown in a second relative position.

Second media guide 238 is moveable relative to tray body 220, such as within a slot 280 formed along bottom wall 222, for example. As discussed above, second media guide 238 is operatively connected to second bracket 250 such that movement of the second media guide generates a corresponding translation or other movement of the second bracket. As such, the second media guide and second bracket are operatively connected to one another, and that operative connection can take any suitable form, configuration and/or arrangement. For example, a second connecting member 282 can be interconnected between the second media guide and the second bracket, as shown in FIGS. 7 and 8. Second connecting member 282 includes a central portion 284 and opposing end portions 286 and 288 respectively disposed toward second media guide 238 and second bracket 250. The second connecting member is shown as being pivotally supported on tray body 220, such as by central portion 282 being pivotally connected along bottom wall 222 thereof, for example.

End portions 286 and 288 can be operatively connected to second media guide 238 and second bracket 250, respectively, in any suitable manner. For example, the second media guide can include a projection 290 extending therefrom, such as through slot 280, for example. End portion 286 can include an elongated slot 292 formed therein that receives projection 290. As the second media guide is moved, projection 290 causes a corresponding movement of second connecting member 282 due to the engagement of the projection with elongated slot 292. Second bracket 250 can also include a projection 294 extending therefrom, and end portion 288 can include an elongated slot 296 that receives projection 294. As the second connecting member moves due to the movement of the second media guide, slot 296 generates a corresponding translation or other movement of second bracket 250 along the tray body, such as along rear wall 224, for example. It will be appreciated that elongated slots 292 and 296 can be of any suitable configuration and/or arrangement. In the embodiment shown, slot 296 includes a single, approximately linear portion. However, slot 292 is shown as including three approximately linear portions 292A-C. Together slot portion 292A and slot 296 generate an approximately 1:1 ratio of movement between the second media guide and the second bracket. However, other ratios can alternately be used, such as a 2:1 ratio established between portion 292B and slot 296 in which the second bracket will move about half of the distance that the second media guide is moved.

As shown in FIGS. 7-10, second bracket 250 includes a bracket wall 298 with support portions 300 extending therefrom for engaging tray body 220, such as along rear wall 224, for example. Second bracket 250 also include a second plurality of engagement portions and a second plurality of non-engagement portions, adapted for operative association with a plurality of size-indicating devices, such as plurality 146, 148, 150 and/or 152 in FIG.1, for example. The engagement portions can be of any suitable shape, form or construction, and can be of any suitable number, such as from about 2 to about 250, for example. In the embodiment shown in FIGS. 7-10, the second plurality of engagement portions include shutoffs or solid wall portions of bracket wall 298, which are indicated by dashed rectangles 302. Additionally, the second plurality of non-engagement portions are suitable for being positioned in operative association with a size-indicating device, such as a device of the plurality of size-indicating devices in FIG. 1, for example, but not contacting, actuating or otherwise operatively engaging a size-indicating device. The non-engagement portions can be of any suitable shape, form or construction, and can be of any suitable number, such as from about 2 to about 250, for example. In the embodiment shown in FIGS. 7-10, the non-engagement portions are rectangular apertures or holes 304 formed through bracket wall 298. Furthermore, the engagement portions and non-engagement portions are shown disposed along bracket wall 298 in approximately evenly spaced rows. While it will be appreciated that any suitable spacing, arrangement and/or configuration can be used, in one embodiment at least one row of engagement and/or non-engagement portions is in alignment with at least one of size-indicating device. In one preferred embodiment, the plurality of size-indicating devices, such as devices 218A-D, for example, are evenly spaced in two or more rows and the engagement and/or non-engagement portions of both the first and second brackets are disposed in corresponding and aligned rows.

As can be seen in FIGS. 7-10, first and second brackets 248 and 250 are disposed adjacent one another and generally at least partially overlap one another. As such, as first and/or third media guide(s) are moved, first bracket 248 is translated or otherwise displaced along the tray body, such as along rear wall 224, for example. Additionally, as second media guide is moved, second bracket 250 is translated or otherwise displaced along the tray body, such as along rear wall 224, for example. Thus, the first and second brackets move independently of one another depending upon the position of the corresponding media guide or guides.

It will be appreciated that the media tray will typically be at least partially removed or otherwise extended from the associated sheet media source when the sheet media guides are being adjusted. As such, the first and second brackets will, in such an extended tray position, be stationed away from and operatively disassociated with any corresponding size-indicating devices. As such, the first and second brackets will be free to move in response to movements of the sheet media guides. It will be appreciated that in such an extended or "tray open" position any associated size-indicating devices will default to an unbiased or unactuated state or condition, such as an "open" condition for a normally-open switch or a "closed" condition for a normally-closed switch, for example. Such a "tray open" condition or state could be represented by a combined switch state of "00000", for example, and a control system, such as control system 108 of printing system 100, for example, can be adapted to recognize such a combined switch state as corresponding to such a "tray open" condition. It will be recognized that in such an arrangement, the use of a dedicated "tray home" switch or device can be avoided. Though it will be appreciated that such a dedicated "tray home" switch could optionally be included.

Figure 11:
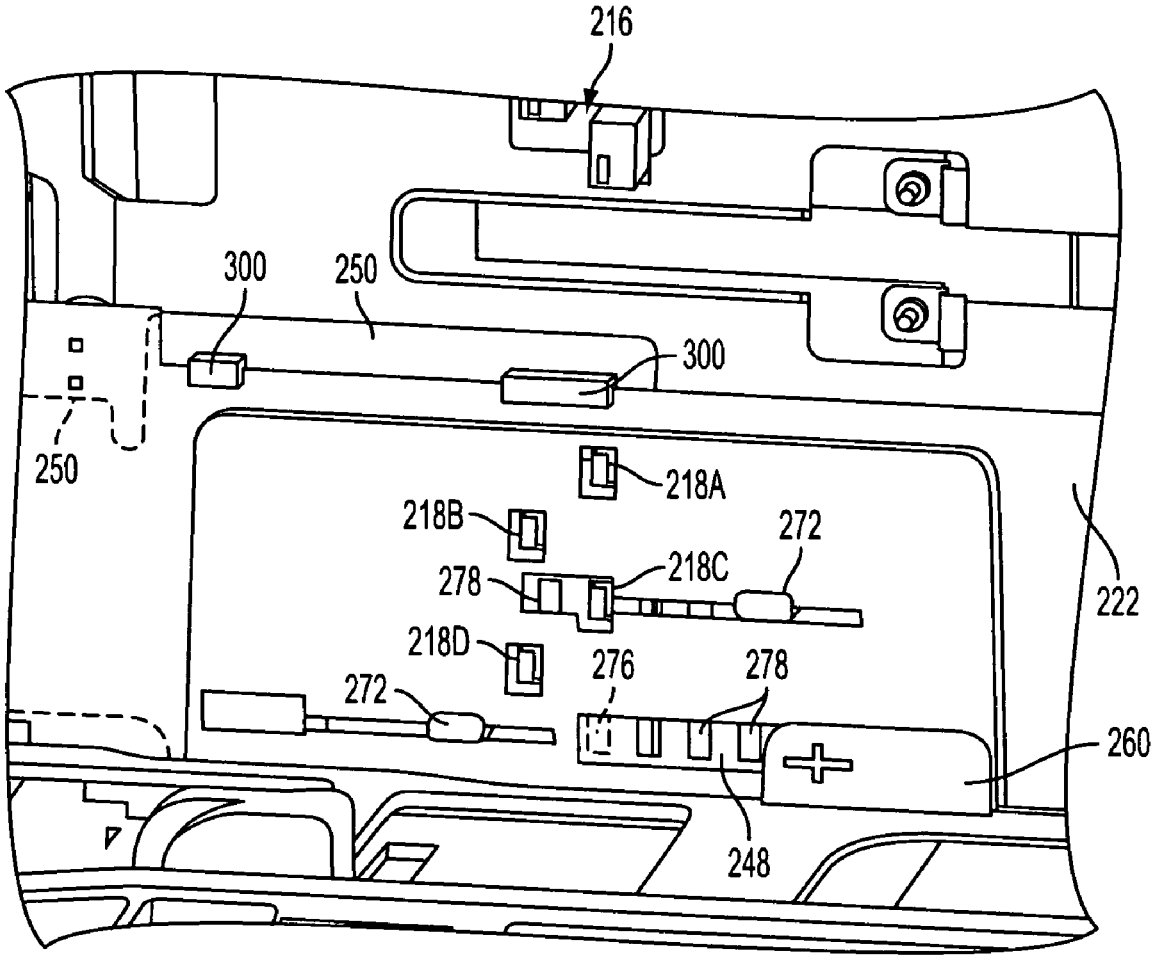
FIG. 11 is a perspective view of a media tray and brackets in operative association with size-indicating devices of the sheet media source in FIG. 2.

Upon positioning the sheet media guides and filling the cavity of the media tray with an associated quantity of sheet media, the media tray will be moved into a closed or installed position in which the first and second brackets will be operatively associated with any corresponding size-indicating devices. Such a closed or installed position is shown in FIGS. 2 and 11 in which the media tray and particularly rear wall 224 as well as first and second brackets 248 and 250 thereof are capable of displacing or otherwise actuating the associated plurality of size-indicating devices. As the media tray is displaced into the closed position, the first and second brackets manipulate the state or condition of the size-indicating devices, which changes the same from a "00000" or "tray open" condition to a different combined switch (or sensor) state condition. For example, a combined switch state condition of "00001" is shown in FIG. 11 in which size-indicating devices 218A-Dare unchanged (i.e., remain "open") by the first and second brackets but size-indicating device 218E (not seen in FIG. 11) is actuated or "closed" by an engagement portion, such as shutoff 276 of first bracket 248, for example, depresses or otherwise actuates the size-indicating device. It will be appreciated that size-indicating devices 218A-D remain unchanged because a non-engagement portion of each of the first and second brackets, such as apertures 278 and 304, for example, are aligned with one another and form a passage through which at least a portion of the size-indicating devices can pass.

Turning now to FIG. 12, a representation of a media size and orientation matrix is provided that includes columns 1 through 9 extending along the bottom of the chart representing media length dimensions and rows A through G extending along the left side representing media width dimensions. A row extends across the top of the chart and represents the combination of engagement portions and non-engagement portions for a bracket and the corresponding effect of the same on a plurality of associated size-indicating devices. Said differently, column 3 corresponds to a length dimension of about 266.7 mm. When the length media guide (e.g., second media guide 238) is stationed for use in association with sheet media having a 266.7 mm length dimension, the corresponding length bracket (e.g., second bracket 250) will be aligned with the size-indicating devices such that the engagement and non-engagement portions of the length bracket will manipulate the group of size-indicating devices in a "closed," "closed," "open," "open," "closed" arrangement, as indicated by characters "11001" in the row across the top of column 3.

Similarly, a column extends along the right side of the chart and represents the combination of engagement portions and non-engagement portions for a bracket and the corresponding effect of the same on a plurality of associated size-indicating devices. For example, row C corresponds to a width dimension of about 184.2 mm. When a width media guide (e.g., first media guide 236 and/or third media guide 240) is stationed for use in association with sheet media having a width dimension of 184.2 mm, the corresponding width bracket (e.g., bracket 248) will be aligned with the size-indicating devices such that the engagement and non-engagement portions of the width bracket will further manipulate the group of size-indicating devices in an "open," "closed," "open," "open," "open" arrangement, as indicated by characters "01000" along the right side of row C.

The intersection of column 3 and row C corresponds to a media size of 184.2 mm by 266.7 mm, which is commonly referred to a Executive size media and which is oriented to feed short-edge first in the media tray. With the sheet media guides set in appropriate positions, the corresponding length and width brackets would be aligned with the associated size-indicating devices as discussed above. As the configured and loaded media tray is pushed into to closed position, the rear most bracket, which in the present embodiment is second or length bracket 250, will be first to engage the associated size-indicating devices. According to the present example, second or length bracket 250 will close the first two switches or sensors (e.g., 218A and 218B) as well as the fifth switch or sensor (e.g., 218E) upon reaching the size-indicating devices, due to corresponding engagement portions of the second or length bracket contacting or otherwise actuating the size-indicating devices. However, the length bracket will not engage, close or otherwise actuate the third and fourth switches or sensors (e.g., 218C and 218D), which will instead pass through a non-engagement portion of the second or length bracket. Immediately after second or length bracket 250 reaches the size-indicating devices, the other bracket, which in this case is first or width bracket 248, reaches the size-indicating devices. Again according to the present example, the first or width bracket will only operate to close the second switch or sensor (e.g., 218B), as indicated by characters "01000" in the right-most column. However, it will be recognized that second or length bracket 250 has already closed the second switch or sensor. As such, the first or width bracket makes no modifications to the combined state or condition of the plurality of associated size-indicating devices.

In the embodiment shown in FIG. 11, second bracket 250 is positioned corresponding to use in association with sheet media of about a 431.8 mm length, which corresponds to an arrangement in which no engagement portions of the second bracket are aligned with the size-indicating devices, as indicated by characters "00000". First bracket 248 is positioned corresponding to use in association with sheet media of about 279.4 mm in width, which corresponds to an arrangement in which only one engagement portion of the first bracket is aligned with the size-indicating devices, as indicated by characters "00001" which corresponds to Tabloid sized media oriented to feed short-edge first. Accordingly, size-indicating devices 218A-D extend through the first and second brackets. However, size-indicating device 218E is engaged by engagement portion 276 and, as such, is not shown.

It will be appreciated that the control system of a printing system, such as control system 108 of printing system 100, for example, will generally be programmed to accommodate a variety of well known and commonly used media sizes as supported media sizes. Sizes of sheet media other than those supported media sizes are typically recognized as "custom" media sizes, which can be accepted and processed by the printing system but which typically require additional input on the part of the user or operator. The control system of a printing system, such as control system 108 of printing system 100, for example, will typically be programmed to recognize and differentiate between supported media sizes as well as determine when a "custom" size is being used. However, rather than interpreting signals from length associated switches and from width associated switches as is done in known systems, each combination of switch or sensor states (e.g., "11001" in column 3, row C and "00001" in column 9, row F) relates to an overall media size rather than a dimension. As such, the combined switch or sensor states or conditions correspond to supported or "custom" media sizes rather than specific media dimensions.

A control system of a printing system, such as control system 108 of printing system 100, for example, includes a memory or storage, such as memory 140 or storage 124, for example, containing data or information corresponding to the combined switch or sensor states or conditions and the media size associated therewith, such as in a data table or matrix, for example. Upon receiving one or more signals or communications from one or more of the size-indicating devices of a plurality of size-indicating devices, such as one of pluralities 146, 148, 150 and 152, for example, the control system will determine the combine state or condition thereof and retrieve the corresponding media size from a memory or storage.

As can be seen from FIG. 12, the number of occurrences of misidentification of smaller sheets of media being identified as larger sheets of media is reduced to 4 occurrences, as indicated by the boxes shown with a bold or heavy border, including 1A, 4D, 6D and 7D. This is a substantial reduction from the 16 occurrences shown in and discussed with regard to FIG. 13. Additionally, it will be appreciated that of the 4 occurrences shown in FIG. 12, one has a width difference of only 8.8 mm and the other three have width differences of only 5.9 mm. In many cases, the border of the sheet of media will be sufficient to accommodate this difference. Furthermore, the number of occurrences of a larger sheet of media being misidentified as a smaller sheet of media have also been reduced from the 14 occurrences shown in FIG. 13 to 9 occurrences shown in FIG. 12 using a double-line border, which include 1C, 2B, 2G, 3D-G, 5E and 8F. As such, a significant reduction in occurrences of misidentification can be achieved.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A media tray for an associated printing system, said media tray comprising:

a tray body including a first wall;

a first media guide moveably supported along said tray body;

a second media guide moveably supported along said tray body and disposed approximately transverse to said first media guide;

a first bracket supported along said first wall and including a first bracket wall with a first plurality of engagement portions and a first plurality of non-engagement portions disposed along said first bracket wall, said first bracket being operatively connected to said first media guide such that moving said first media guide relative to said tray body causes a related translation of said first bracket along said first wall; and, a second bracket supported along said first wall and including a second bracket wall with a second plurality of engagement portions and a second plurality of non-engagement portions disposed along said second bracket wall, said second bracket being operatively connected to said second media guide such that moving said second media guide relative to said tray body causes a related translation of said second bracket along said first wall.

2. A media tray according to claim 1, wherein at least one of said first plurality of non-engagement portions or said second plurality of non-engagement portions includes from about 2 to about 100 apertures formed through a corresponding one of said first bracket wall or said second bracket wall.

3. A media tray according to claim 1, wherein at least one of said first plurality of engagement portions or said second plurality of engagement portions includes from about 2 to about 100 wall areas integrally formed along a corresponding one of said first bracket wall or said second bracket wall.

4. A media tray according to claim 1, wherein at least one of said first plurality of engagement portions or said second plurality of engagement portions is disposed in a first plane, and said first plane is approximately aligned with a corresponding one of said first bracket wall or said second bracket wall.

5. A media tray according to claim 1, wherein said second bracket is supported along said first wall adjacent said first bracket such that said first and second bracket walls at least partially overlap one another.

6. A media tray according to claim 5, wherein said first plurality of engagement portions and said first plurality of non-engagement portions are disposed along said first bracket wall in a first plurality of rows, and said second plurality of engagement portions and said second plurality of non-engagement portions are disposed along said second bracket wall in a second plurality of rows, and said first and second brackets are supported along said first wall such that at least one row of said first plurality of rows and at least one row of said second plurality of rows are approximately aligned with one another.

7. A media tray according to claim 1 further comprising a first connecting member operatively connected between said first media guide and said first bracket.

8. A media tray according to claim 7, wherein said first connecting member includes a first elongated slot, and said first media guide includes a projection engaging said first elongated slot.

9. A media tray according to claim 8, wherein said first elongated slot includes a first slot portion extending in a first direction and a second slot portion extending in a second direction different from said first direction.

10. A media tray according to claim 7 further comprising a second connecting member pivotally supported on said tray body and operatively connected between said second media guide and said second bracket.

11. A media tray according to claim 10, wherein said second connecting member includes a second elongated slot, and said second media guide includes a projection engaging said second elongated slot.

12. A media tray according to claim 11, wherein said second elongated slot includes a first slot portion extending in a first direction and a second slot portion extending in a second direction different from said first direction.

13. A printing system comprising:

a sheet media source including a sheet media tray for supporting a quantity of associated sheets of media having first and second associated dimensions;

a marking unit in operative communication with said sheet media source and adapted to receive sheets of media therefrom;

a sheet media output in operative communication with said marking unit; and, a control system in communication with at least said marking unit and including a plurality of size-indicating devices disposed along said sheet media source in operative association with said sheet media tray, said size-indicating devices adapted to generate an output signal indicative of a state thereof;

said sheet media tray including:

a tray body for receiving the quantity of associated sheets of media, said tray body including a bottom wall and a rear wall extending from said bottom wall;

first and second media guides supported along said tray body and moveable relative to said bottom wall; and, first and second brackets moveably supported along said rear wall and at least partially overlapping one another, said first bracket including a first plurality of apertures and said second bracket including a second plurality of apertures, said first bracket being operatively connected to said first media guide such that a movement of said first media guide generates a corresponding translation of said first bracket relative to said rear wall, and said second bracket being operatively connected to said second media guide such that a movement of said second media guide generates a corresponding translation of said second bracket relative to said rear wall.

14. A printing system according to claim 13, wherein said control system includes a controller in communication with said plurality of size-indicating devices and a memory in communication with said controller, said memory storing data correlating a combined state of said plurality of size-indicating devices with a size of the quantity of associated sheets of media, and said controller adapted to receive said output signals from said plurality of size-indicating devices and determine a size of the quantity of associated sheets of media therefrom.

15. A printing system according to claim 13, wherein said sheet media source includes first and second frame walls, and said sheet media tray is displaceably supported on said first and second frame walls for movement between a first position in which said sheet media tray is at least partially extended from said frame walls and a second position in which at least one of said first and second brackets is operatively associated with said plurality of size-indicating devices.

16. A printing system according to claim 15, wherein said first and second brackets are supported along said rear wall such that at least one aperture of said first plurality of apertures and at least one aperture of said second plurality of apertures are in approximate alignment with one another and in approximate alignment with a first size-indicating device of said plurality of size-indicating devices such that said first and second brackets are operatively disengaged from said one size-indicating device in said second position of said sheet media tray.

17. A printing system according to claim 16, wherein said first bracket includes a first plurality of engagement portions and said second bracket includes a second plurality of engagement portions, and at least one engagement portion of one of said first or second pluralities of engagement portions is operatively engaged with a second size-indicating device of said plurality of size-indicating devices in said second position of said sheet media tray.

18. A printing system according to claim 13, wherein said marking unit is a xerographic marking unit, and said plurality of size-indicating devices includes from about 2 to about 10 size-indicating devices with each size-indicating device including one of a non-contact sensor or a contact-type electrical switch.

19. A method of operating a printing system, said method comprising:

a) providing a printing system including a sheet media source, a marking unit in operative association with said sheet media source, a sheet media outlet in operative with said marking unit, and a control system in communication with at least said marking engine and including a plurality of size-indicating devices disposed along said sheet media source, each of said plurality of size-indicating devices having an operative state;

b) providing a sheet media tray for receiving a quantity of sheets of media having first and second dimensions, said sheet media tray including a tray body supporting the quantity of sheets of media and a first wall, a first media guide moveably supported on said tray body, a second media guide moveably supported on said tray body and disposed generally transverse to said first media guide, a first bracket supported along said first wall and operatively connected to said first media guide, and a second bracket supported along said first wall and operatively connected to said second media guide, said first bracket including a first plurality of engagement portions and a first plurality of non-engagement portions, and said second bracket including a second plurality of engagement portions and a second plurality of non-engagement portions;

c) moving said sheet media tray into a first tray position in which said first and second sheet media guides are exposed;

d) moving said first media guide into a first guide position which has a relation to the first dimension of the quantity of sheets of media, said movement of said first media guide causing a corresponding movement of said first bracket relative to said first wall, said movement of said first bracket causing one or more of said first plurality of engagement portions and one or more of said first plurality of non-engagement portions to be disposed in approximate alignment with said plurality of size-indicating devices;

e) moving said second media guide into a second guide position which has a relation to the second dimension of the quantity of sheets of media, said movement of said second media guide causing a corresponding movement of said second bracket relative to said first wall, said movement of said second bracket causing one or more of said second plurality of engagement portions and one or more of said second plurality of non-engagement portions to be disposed in approximate alignment with said plurality of size-indicating devices;

e) moving said sheet media tray into a second tray position in which at least one of said first and second brackets is operatively associated with said plurality of size-indicating devices; and, f) determining a size of said quantity of sheets of media based at least in part upon an operative state of said plurality of size-indicating devices as influenced by at least one of said first and second brackets.

20. A method according to claim 19, wherein said plurality of size-indicating devices each generate an output signal indicative of an operational state thereof, said control system includes a controller in communication with said plurality of size-indicating devices and a memory in communication with said controller, said memory storing data correlating combined operative states of said plurality of size-indicating devices and sheet media sizes, and f) includes receiving said output signals at said controller and determining said size of said quantity of sheets of media from said data.

* * * * *